United States Patent [19]

Nayfa et al.

[11] 3,931,662

[45] Jan. 13, 1976

[54] FLOOR CLEANING MACHINE WITH VACUUM PICKUP

[76] Inventors: James E. Nayfa, 5015 Sharp St., Dallas, Tex. 75247; Andrew D. Stanley, 2306 Cedar Way Drive, Dallas, Tex. 75241

[22] Filed: Aug. 20, 1973

[21] Appl. No.: 390,023

Related U.S. Application Data

[62] Division of Ser. No. 147,866, May 28, 1971, Pat. No. 3,761,987.

[52] U.S. Cl. ..... 15/320; 15/340; 15/346; 15/380

[51] Int. Cl.[2] ..... A47L 7/00

[58] Field of Search..... 15/50 R, 320, 346, 340, 15/380

[56] References Cited

UNITED STATES PATENTS

| | | | |
|---|---|---|---|
| 551,773 | 12/1895 | LeClerc | 15/50 R |
| 1,923,689 | 8/1933 | Rosenberg | 15/346 X |
| 2,731,659 | 1/1956 | Coplen | 15/380 X |
| 3,402,420 | 9/1968 | Schaeffer | 15/340 X |
| 3,663,984 | 5/1972 | Anthony et al. | 15/321 |

FOREIGN PATENTS OR APPLICATIONS

| | | | |
|---|---|---|---|
| 89,188 | 4/1967 | France | 15/50 R |

*Primary Examiner*—Robert W. Jenkins
*Assistant Examiner*—C. K. Moore
*Attorney, Agent, or Firm*—Peter J. Murphy

[57] ABSTRACT

A self-propelled machine includes a main housing supported on front and rear drive rollers and has an operator control handle extending from the rear. Front and rear elongated working brushes are driven in orbital movement in horizontal planes, with the front brush being positioned ahead of the front roller and the rear brush positioned behind the rear roller. A supply tank for the working solution includes agitating and aerating means for creating a foam dispensed from a pressurized tank through a flow control gate, and applied to the floor surface ahead of the front brush. The drive rollers act as squeegies. A collection system includes vacuum pickup nozzles adjacent each of the drive rollers for picking up material from the floor surface which is collected in a collection tank.

8 Claims, 15 Drawing Figures

FLOOR CLEANING MACHINE WITH VACUUM PICKUP

REFERENCE TO RELATED APPLICATION

This application is a division of application Ser. No. 147,866 filed May 28, 1971 now U.S. Pat. No. 3,761,987, issued Oct. 2, 1973.

BACKGROUND AND SUMMARY OF THE INVENTION

This invention relates to a machine for scrubbing or shampooing rugs or carpeted floor surfaces, for scrubbing hard floor surfaces, or for waxing and polishing hard floor surfaces.

A variety of machines have been devised for cleaning rugs or carpets through the use of detergents generated and applied in the form of a dry foam in the path of shampooing brushes intended to work the foam into the pile to entrap the dirt held therein, with the foam and entrapped dirt then being extracted from the carpet surface through a vacuum pickup system. A disadvantage of some machines is that the cleaning medium and entrained dirt must be collected in a separate operation. This results in extra work, considerable wetting of the nap surface for more difficult removal of the dirt, and longer drying time.

An object of this invention is to provide an improved floor surface cleaning machine having the capability to shampoo and remove surface dirt from a carpet surface in one operation, to scrub and remove surface dirt from a hard floor surface in one operation, or to apply wax to and polish a floor surface in one operation.

A further object of this invention is to provide a floor surface cleaning machine having a cleaning solution foaming system within the machine and a pressurized foam dispensing system.

Still another object of this invention is to provide a rug cleaning machine having means for scrubbing the pile, removing the dirt from the pile, and lifting the pile to original position in one operation.

Another object of this invention is to provide a rug cleaning machine wherein the machine support and drive rollers function as squeegies to direct the cleaning foam and entrapped dirt toward the vacuum pickup nozzles.

Still another object of this invention is to provide a floor surface cleaning machine having an improved solution dispensing mechanism including means for forming a foam, means for effecting flow of the foam under pressure, and means for controlling the rate of flow of foam to the floor surface.

For accomplishing these objects, a machine according to the invention includes a housing having front and rear support and traction means, and power means for driving the traction means. One elongated brush means is disposed ahead of the front traction means to act on the floor surface, and the power drive means for the brush provides motion of the brush in a horizontal plane. The machine housing contains a cleaning medium supply and dispensing system including dispensing means at the front of the machine ahead of the brush. A collection system includes a collection tank associated with the housing, an elongated suction nozzle disposed behind said brush to pickup material from the floor surface, and an air pump having its suction side communicating with said collection tank. In more particularity, the invention includes a squeegee roller as the front traction with the suction nozzle disposed just ahead of the squeegee roller; a skirt depending from the housing defining an enclosure for the dispensing means, traction means, brush and suction nozzle; and said air pump discharging air into said enclosure.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
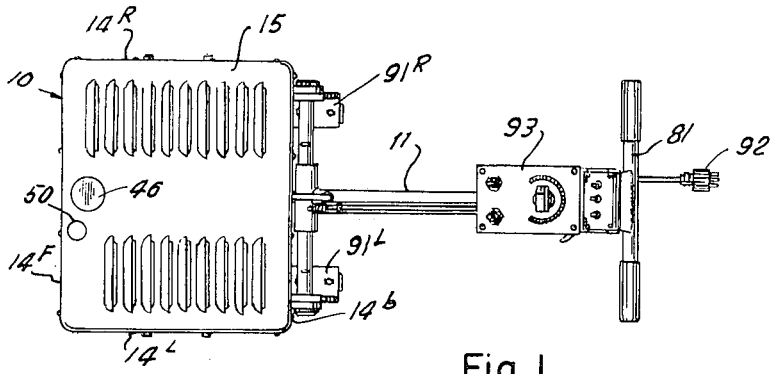
FIGS. 1 through 4 are general views of a preferred form of machine as viewed, respectively, from a top, left side, front and rear of the machine.
Figure 5:
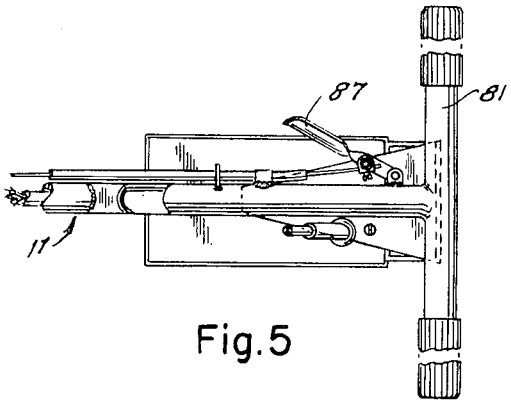
FIGS. 5 and 6 are fragmentary detail views of the machine handle and controls as viewed from the respective planes indicated in FIG. 2.
Figure 2:
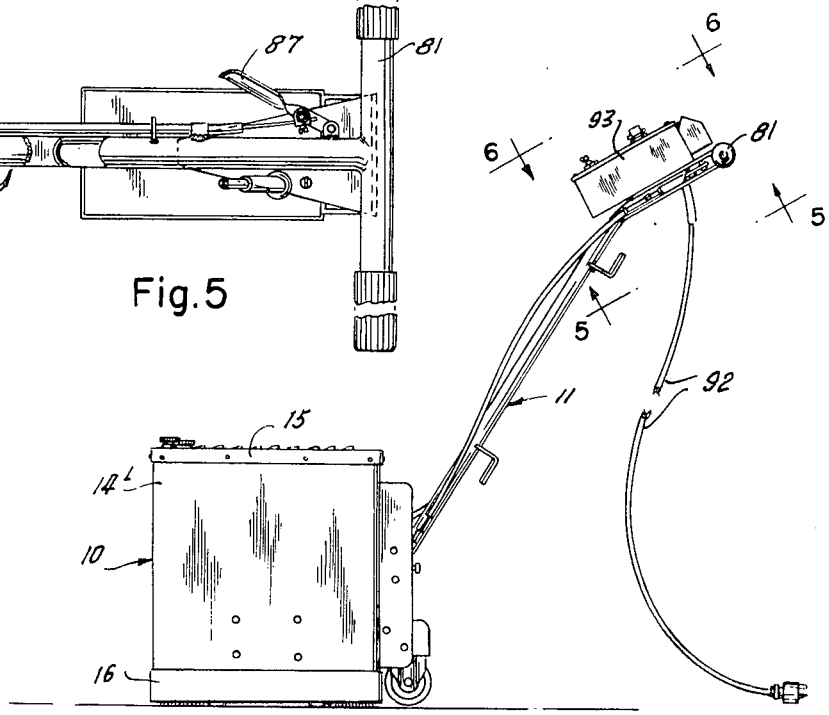

As seen in the drawings, the machine is enclosed in a generally cube shaped housing 10, the machine being self-propelled; and a control handle 11 is attached to the rear wall of the housing by means of which the machine may be manually guided by the operator to the extent necessary, the handle also having various controls mounted thereon for automatic control by the operator.

The machine housing or frame 10 is an integrated structure including a floor plate 13 and rear, left side, front, and right side walls 14B, 14L, 14F and 14R, respectively. As viewed in plan in FIG. 1, the handle 11 is attached to the rear wall of the machine which, in normal forward operation, moves from right to left as viewed in this figure. The references to left and right sides of the machine are considered from the vantage point of the operator at the handle 11. A top cover 15, best seen in FIGS. 1 and 9, encloses the top of the housing and is removable for servicing. As will be described, the housing 10 is supported somewhat above the floor surface, and a flexible skirt 16 defines a downward extension of the housing walls terminating close to the floor surface.

Figure 11:
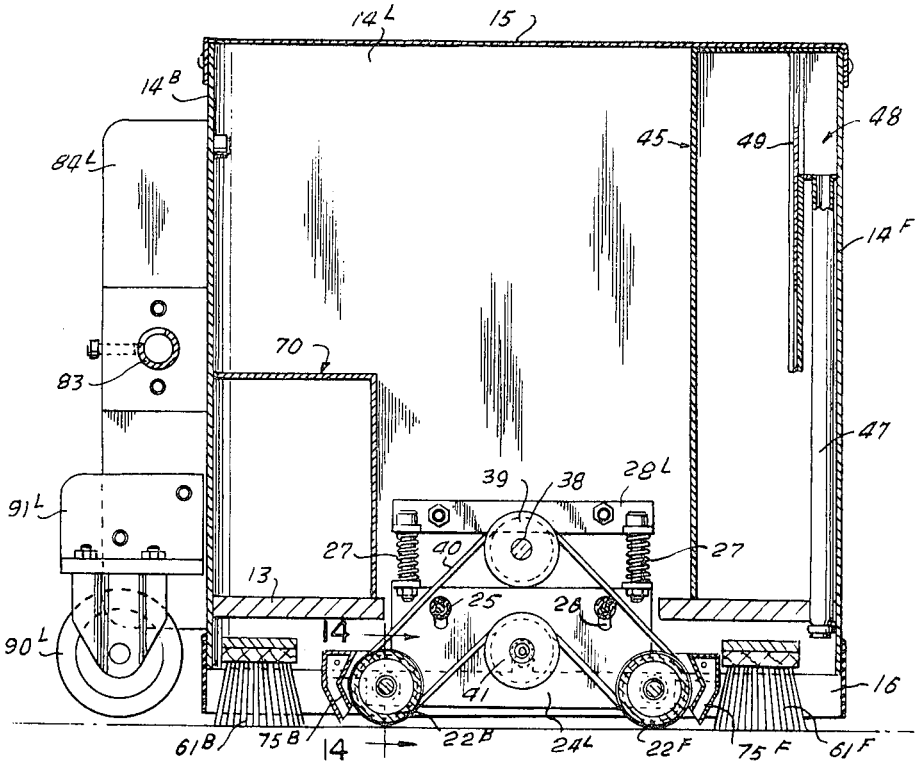
FIG. 11 is a vertical sectional view taken in the plane 11—11 of FIG. 8 adjacent to the left side wall as viewed from the right side of the machine.
Figure 12:
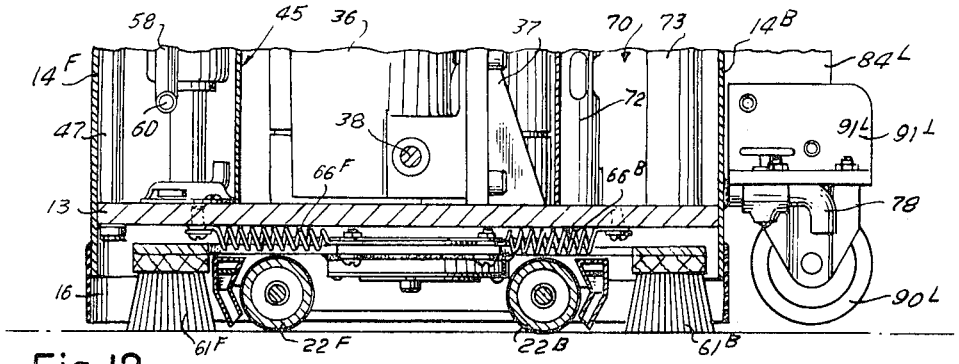
FIG. 12 is a fragmentary sectional view taken in the vertical plane 12—12 of FIG. 7 particularly illustrating the brush supporting mechanism.

The machine is supported and propelled by front and rear drive rollers 22F and 22B rotatably supported in left and right roller brackets 24L and 24R respectively which are floatingly attached to the left and right sidewalls 14L and 14R respectively. As best seen in FIG. 11, the roller bracket 24L is supported for vertical floating movement relative to the wall 14L by means of supporting bolts 25 extending through vertically elongated slots 26 in the roller bracket. The roller brackets 24 then define a form of chassis for the machine; and the housing 10 is supported on the chassis by means of compression springs 27 confined between load bearing ears on the wheel brackets 24 and load bearing pads on load brackets 28L and 28R secured to the sidewalls 14L and 14R respectively. In this manner, the housing 10 is resiliently supported on the chassis defined by the roller brackets 24L and 24R.

Figure 14:
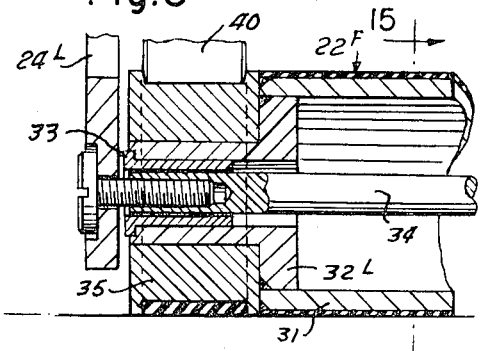
FIG. 14 is a fragmentary sectional view of a drive roller and associated support bracket as viewed in the plane 14—14 of FIG. 11.

As best seen in FIG. 14, each of the rollers 22 comprises a welded structure of an elongated cylindrical tube 31 having a resilient surface layer, and left and right hub structures 32L and 32R respectively. The hub structures include axial bores for retaining sleeve type bushings 33 by means of which the rollers are rotatably supported on elongated shafts 34 which extend between and are suitably secured to the roller brackets 24L and 24R. For driving the rollers, belt pulleys 35 are secured to the hubs 32L at the left ends of the two drive rollers.

Figure 8:
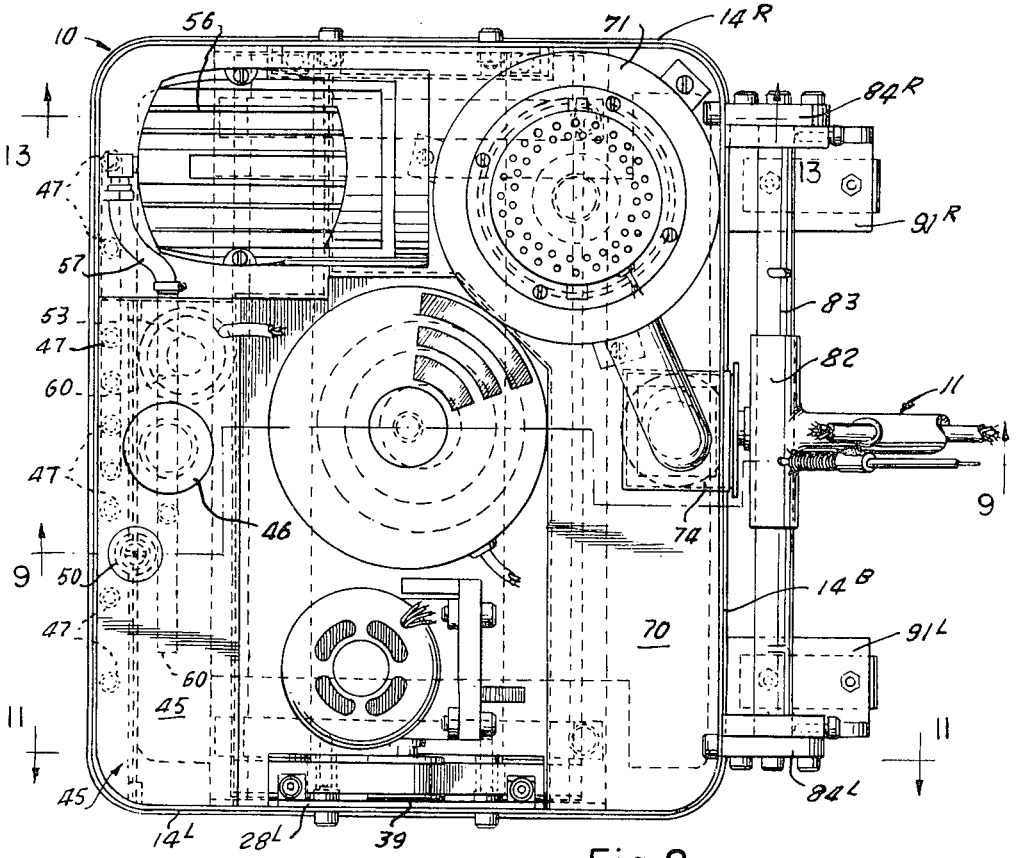
FIG. 8 is a view of the top of the machine, with the top cover removed.
Figure 4:
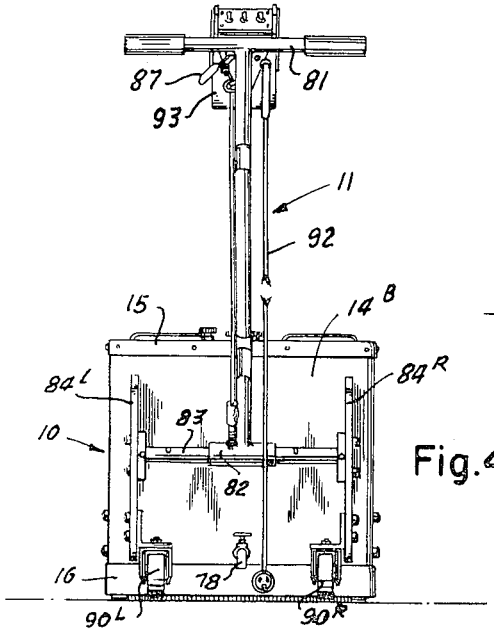
Figure 13:
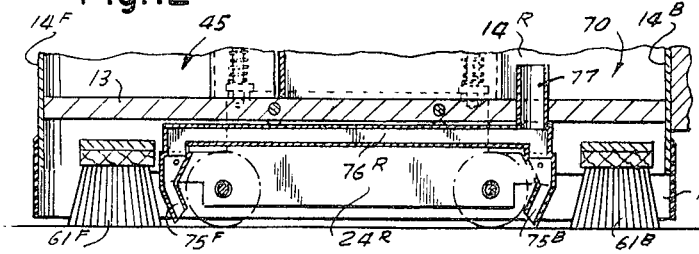
FIG. 13 is a fragmentary sectional view taken in the vertical plane 13—13 of FIG. 8, particularly illustrating the vacuum pickup nozzles and manifold.

The drive motor and gear box unit 36 for the drive rollers is best seen in FIGS. 8 and 13, this unit being mounted on a bracket 37 supported on the floor plate 13. The horizontal output shaft 38 from the gear box extends toward the left side wall and carries a drive pulley 39 disposed in the plane of the drive roller pulleys 35. A drive belt 40 couples the drive pulley 39 and the roller pulleys 35, this belt also passing over an idler pulley 41 rotatably supported on the roller bracket 24L, so that the two drive rollers are driven simultaneously by the drive motor unit 36.

A solution dispensing system includes a supply tank 45 formed integrally with the housing 10 adjacent to the front and left sidewalls. This tank is a sealed tank extending to the top of the housing and includes a filler opening and cap 46 for supplying materials to the tank. The materals are dispensed from the tank through seven vertical dispenser tubes 47 laterally spaced along the front of the housing adjacent to the front wall, these tubes extending from a trough 48 formed at the upper portion of the tank 45 and downward through openings provided in the floor plate 13. The trough 48 is a horizontal trough formed by the front wall 14F, a horizontal bottom plate having openings communicating with the upper ends of the dispenser tubes 47, and a rear wall formed by a weir gate 49 supported for reciprocating vertical movement in plane parallel to the front wall. The weir gate is supported from a control helix 50 threaded through a threaded bushing in the top of the supply tank, and including a manual knob extending from the top of the housing for control by the operator. Through this control helix, the weir gate is raised or lowered to regulate the horizontal opening defined between the weir gate and the top of the tank which communicates the trough 48 with the remainder of the supply tank 45.

An electric motor-pump unit 53 is mounted within the supply tank 45 on the floor plate 13 for agitating and mixing the solution in the supply tank as desired.

Air for pressurizing the supply tank and for aerating and foaming the solution within the tank is provided from an air compressor-electric motor unit 56 mounted adjacent to the right front corner of the machine housing. The compressor outlet includes a flexible conduit 57 between the compressor and the supply tank, a conduit 58 within the tank including horizontal and vertical branches, and a horizontal T nozzle 59 providing two nozzle outlets 60. In operation, the solution in the tank is agitated by the motor-pump unit 53 and aerated by the compressor unit 56 to produce a foam which is caused to flow from the main tank chamber into the trough 48 as a result of the pressurization of the tank. The solution is then dispensed from the dispenser tubes 47 being discharged adjacent to the front wall 14F.

Figure 9:
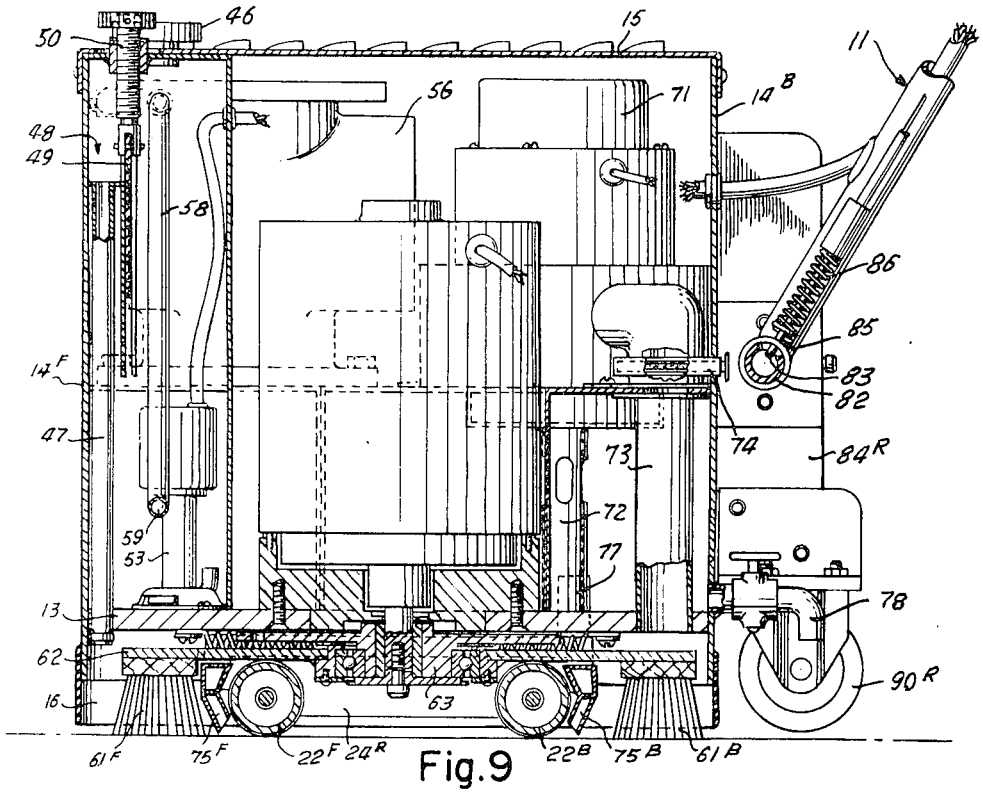
FIG. 9 is a sectional view taken in the vertical plane 9—9 of FIG. 8 looking from the left side of the machine.
Figure 10:
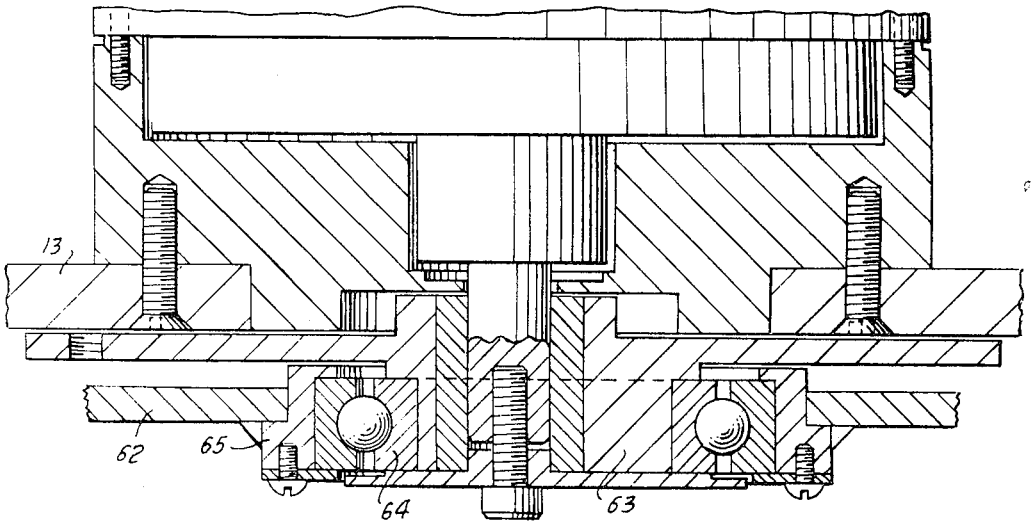
FIG. 10 is an enlarged fragmentary view of the brush drive mechanism illustrated in FIG. 9.

The working brushes for the machine are elongated front and rear brushes 61F and 61B, respectively, having downwardly extending bristles. The brushes are supported on a horizontal brush plate 62, supported just below the floor plate 15, with the brushes extending transversely parallel to and adjacent to the housing front and rear walls. The support end drive for the brushes is best seen in FIGS. 9 and 10 and also in FIG. 7.

The power unit for the brush system is a vertically disposed electric motor 67 supported at the center of the machine housing on the floor plate 13. The motor drive shaft extends downwardly through an opening the floor plate, and has non-rotatably fixed thereto an eccentric drive plate 63 including a fly wheel portion and an eccentric boss. An antifriction rotation and thrust bearing 64 has its inner race secured to the eccentric boss; and a mounting collar 65 associated with the brush plate 62 is secured to the outer race of this bearing. In this manner, the brush plate 62 is secured to and partially supported by the eccentric drive plate 63.

Figure 7:
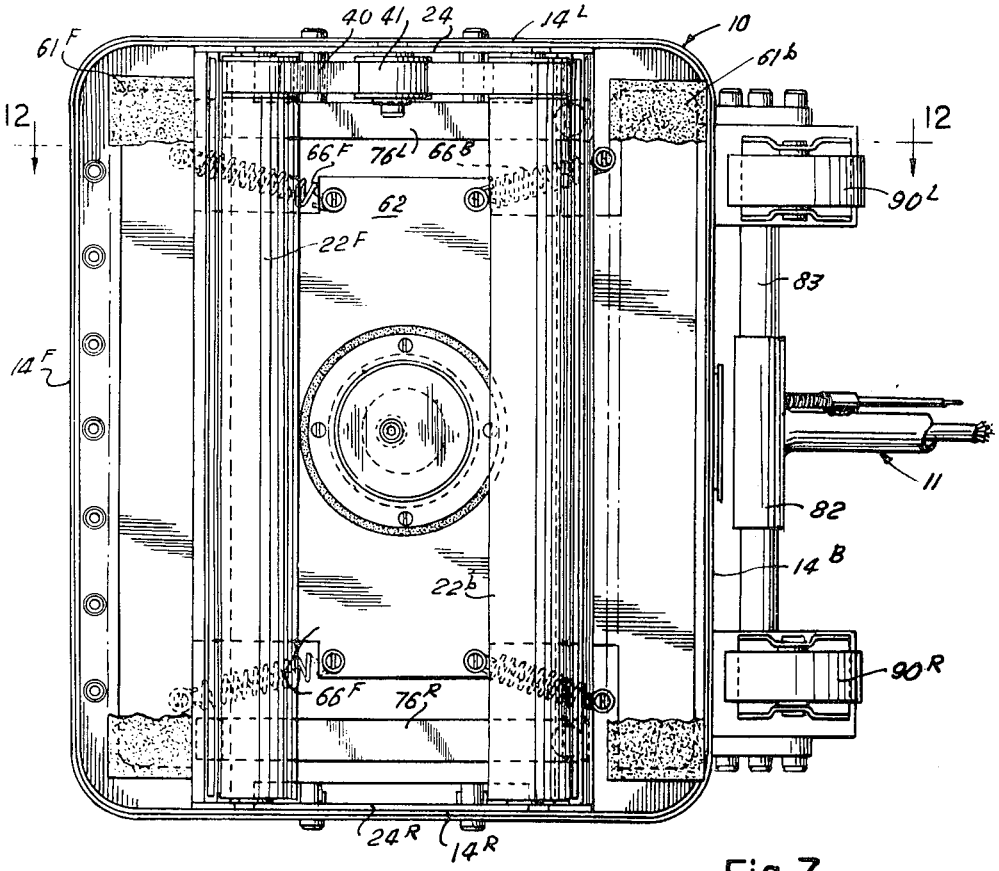
FIG. 7 is a view from the bottom of the machine of FIGS. 1 through 4.
Figure 3:
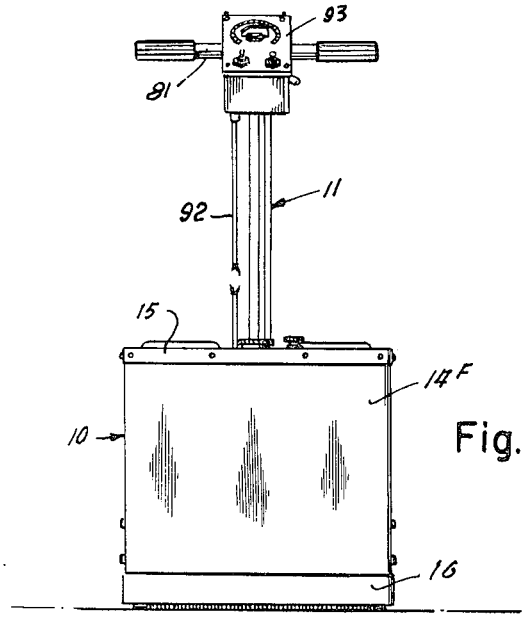
Figure 15:
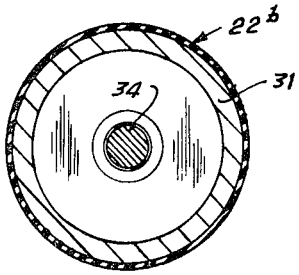
FIG. 15 is a sectional view of a support and drive roller as viewed in the plane 15—15 of FIG. 14.

As best seen in FIG. 7 and 13, the brush plate is generally co-extensive with the floor plate of the machine housing; and the brush plate is further laterally supported by means of a pair of front tension springs 66F and a pair of rear tension springs 66B. The front springs 66F are anchored between the housing floor plate and the brush plate to urge the brush plate toward the front of the machine, while the rear springs 66B are connected between the floor plate and the brush plate to urge the brush plate toward the rear of the machine. The springs 66 then form a lateral suspension system for the brush plate to facilitate orbital drive of the brush plate and brushes 61 by the eccentric drive mechanism. As best seen in FIG. 9, the front brush 61F is spaced sufficiently from the housing front wall to permit the dispensing of the solution from the dispensing tubes 47 ahead of the front brush.

The vacuum pickup system for the machine includes a collection tank 70 which is formed integrally with the housing floor plate and rear wall, extending laterally across the machine. An electric motor-vacuum pump unit 71 is mounted on the collection tank at the right rear corner of the housing and includes an inlet pipe 72 which extends vertically through the tank. The inlet tube includes inlet openings at the upper end of the tube to withdraw air only from the upper portion of the collection tank 70. The vacuum pump discharge conduit 73 extends downwardly from the unit discharging through the floor plate 13 to the area beneath the floor plate enclosed by skirt 19. A filter unit 74 is provided within the outlet conduit including a filter element removable from a rear housing wall.

The machine is provided with an elongated front and rear vacuum nozzles 75F and 75B which extend laterally across the machine; the front nozzle 75F being disposed forwardly of the front drive roller 22F, and the rear vacuum nozzle 75B being disposed rearwardly of the rear drive roller 22B. The vacuum nozzles are connected at their ends to respective left and right manifolds 76L and 76R, each of these manifolds including an upright discharge pipe 77 which extends through the housing floor into the collection tank 70. In operation, the vacuum created within the collection tank 70 causes withdrawal of the foam or dirt from the floor surface through the nozzles 75 and the manifolds 76, which material is drawn into the lower portion of the tank. Since the discharge pipes 77 extend only a short distance above the housing floor surface, the discharge materials settle in the lower portion of the tank, and the relatively cleaner air is withdrawn from the tank through vacuum pump inlet tube openings adjacent to the top of the tank. A drain faucet 78 is provided for draining the collection tank.

The handle 11 is an elongated member including a T grip 81 at the outer end and a T base 82 in the form of a sleeve at the opposite end. The handle is coupled to the housing 10 by means of a transverse support pipe 83 nonrotatably mounted between left and right support brackets 84L and 84R secured to the housing rear wall. Since the machine is self-propelled, the handle is used for minimal machine guidance by the operator, and also to support the control panel for automatic control of the machine. For this purpose, the handle should be free to swivel on the support pipe 83 so that the T grip 81 may be held at a convenient height by the operator. For supporting the handle at a minimum height, the handle is provided with a latch pin 85 for engagement in a suitable angularly elongated recess in the support pipe 83. The pin mechanism is best illustrated in FIG. 9 which shows the latch pin 85 urged by a compression spring 86 into a pipe recess. A lever 87 at the grip end of the handle is coupled to the latch pin 85 through a cable or link for the purpose of releasing the latch pin when desired.

This handle latching feature is also desirable for the purpose of transporting the machine over floor surfaces from one area of use to another. For this purpose the machine housing is provided with a left and right transport wheels 90L and 90R rotatably supported on suitable wheel brackets 91L and 91R mounting on the housing rear wall. These transport wheels are mounted on the housing to be normally supported above the floor surface, and are engaged with the floor when the machine it tilted backward by means of the handle 11 wherein the machine is entirely supported on the transport wheels and conveniently moved by the operator to a different area for use.

Figure 6:
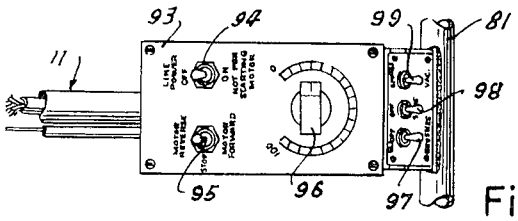

As indicated above, all of the powered elements for the machine are driven by electric motors; and electric energy is supplied through a conventional power cord 92 connected to a suitable control box and panel 93 mounted on the handle 11 adjacent to the T grip 81. As best seen in FIG. 6, the control panel includes a main line switch 94, a reversible motor switch 95 for controlling the direction of drive of the roller drive motor 36, and an associated rheostat 96 for controlling the speed of the drive motor. Other controls are an on-off switch 97 for the brush drive motor 67, an on-off switch 98 for the supply tank compressor and agitator pump motors, and an on-off switch 99 for the vacuum pump unit 71.

The operation of the above described machine for several of its functions will now be briefly described.

For scrubbing or shampooing a rug or carpet, the supply tank 45 is first charged with the appropriate treatment materials such as a suitable proportion of water and liquid detergent. Prior to the cleaning operation, the agitator pump and compressor are turned on to appropriately mix the solution and create the desired foam, while simultaneously pressuring the supply tank to the desired pressure. During this operation, the weir gate may be moved to its upper closed position by the control heliz 50 to prevent flow of the solution foam into the trough 48.

After positioning the machine to begin the cleaning operation, the weir gate is opened to effect the desired flow of detergent from the dispensing tubes, the brush drive motor is energized, and the roller drive motor is energized to propel the machine in a forward direction. The vacuum system is also energized. The machine moves forward at an appropriate rate of speed so that the cleaning solution, which is applied uniformly across the machine path from the several dispensing tubes 47, is worked into the rug pile by the orbiting forward brush 61F to effectively clean all surfaces of the pile fibers and to work the cleaning foam to the base of the pile.

As the forward drive roller 22F moves toward the scrubbed area, the squeegee action effected by the weight of the machine urges the foam forward toward the front vacuum pickup nozzle 75F. The rear vacuum pickup nozzle 75B picks up any materials from the surface which remain; and the orbiting rear brush 61B effects a circular swirling action of the pile fibers to lift the pile to its original as-new position. The air circulated by the vacuum system is returned to the underside of the housing through the discharge tube 73, after being filtered, to effect a continuous circulation of air to assist in the drying of the surface enclosed within the machine skirt 16.

For a hard floor surface scrubbing or wax stripping operation, the machine functions in a similar manner. For this operation the forward operating brush 61F would be a different type of brush for performing a desired scrubbing or stripping operation; and a rear brush 61B would not be required.

For a floor waxing operation, a relatively quick drying foam wax solution may be dispensed to the floor surface with the same foaming and dispensing system, the forward brush 61F may be particularly adapted for distributing the wax foam uniformly over the floor surface. The vacuum system may be operated as an air circulating system wherein the air is directed to the area enclosed by the machine walls 14 and skirt 16 and recirculated through the vacuum pickup nozzles 75F and 75B to assist in the drying of the wax. The rear brush 61B then may be a polishing brush for applying a final polish to the floor surface.

What has been described is an improved floor treatment machine which is particularly adapted for the shampooing of rugs or carpeted floor surfaces including the application of the shampoo and the pickup of the dirt in one continuous operation.

An important feature of the invention is the collection system which provides for picking up the cleaning medium and entrained dirt immediately following the scrubbing by the brush. Another feature is the enclosure for the brush means, traction means, and suction nozzle and the flowing of air through the enclosure to assist in drying the floor surface.

Another feature of the machine is the solution preparation and dispensing system which produces an effective foam capable of being flowed to the floor surface at a controlled rate under air pressure.

While a preferred embodiment of the invention has been illustrated and described, it will be understood by those skilled in the art that changes and modifications may be resorted to without departing from the spirit and scope of the invention.

What is claimed is:

1. A machine for treating floor surfaces comprising a housing having front and rear ends in relation to normal movement over a floor surface in one direction, and having a generally horizontal floor;

front and rear traction means, for supporting and driving said housing along the floor surface, spaced from said housing front and rear ends respectively;

supply means in said housing for supplying a cleaning medium, including dispensing means disposed at the front end thereof; elongated brush means extending across said housing behind and adjacent to said dispensing means; power means in said housing for producing movement of said brush means in the floor plane relative to said housing;

a collection system including a collection tank associated with said housing, an air pump having its suction side communicating with said tank, an elongated suction nozzle disposed under said housing floor behind and adjacent to said elongated brush means, and a manifold communicating said suction nozzle with said collection tank;

said front traction means comprising an elongated roller generally coextensive with said brush means functioning as a squeegee roller; and said elongated nozzle being positioned directly ahead of said roller.

2. A machine as set forth in claim 1 second brush means extending transversely across said housing behind said rear traction means.

3. A machine as set forth in claim 1 a second elongated suction nozzle disposed adjacent to the rear end of the machine; said second suction nozzle being connected to said manifold.

4. A machine as set forth in claim 5 said rear traction means being an elongated roller coextensive with said front traction means and functioning as a squeegee roller; said second nozzle being disposed behind and adjacent to said rear traction roller.

5. A machine for treating floor surfaces comprising a housing having front and rear ends in relation to normal movement over a floor surface in one direction, and having a generally horizontal floor; means mounted on said housing for supporting said housing for movement along a floor surface;

supply means in said housing for supplying a cleaning medium, including dispensing means disposed at the front end thereof under said housing floor; brush means disposed under said housing floor behind and adjacent to said dispensing means; power means in said housing for producing movement of said brush means in the floor plane relative to said housing;

a collection system including a collection tank associated with said housing, an air pump having its suction side communicating with said tank, an elongated suction nozzle disposed under said housing floor behind and adjacent to said brush means, and conduit means communicating said suction nozzle with said collection tank;

a continuous skirt depending from said housing and defining, with said housing floor and with the floor surface, an enclosure for said dispensing means, said brush means and said suction nozzle;

and a discharge conduit means communicating the discharge side of said air pump with a discharge port in said housing floor, to direct the pump discharge air into said enclosure for forced drying of the floor surface; said discharge port being spaced from the assembly of said dispensing means, said brush means, and said nozzle means to effect substantial exposure of the floor surface to air recirculated from said discharge port to said nozzle means.

6. A machine as set forth in claim 5 air filter means disposed in said pump discharge conduit.

7. A machine for treating floor surfaces comprising a housing having front and rear ends in relation to normal movement over a floor surface in one direction, and having a generally horizontal floor;

means mounted on said housing for supporting said housing for movement along the floor surface;

supply means in said housing for supplying a cleaning medium, including dispensing means disposed at the front end thereof; brush means mounted under said housing behind and adjacent to said dispensing means; power means in said housing for producing movement of said brush means in said floor plane relative to said housing;

said cleaning medium supply means including a sealed supply tank in said housing for containing a liquid solution, a source of compressed air communicating with said tank for pressurizing said tank and for producing a foam of the solution therein, means in said supply tank for agitating and mixing the solution therein, elongated transverse trough means in said tank defining the dispensing means, and adjustable gate means for regulating the flow of solution foam from said supply tank into said trough;

a collection system including a collection tank associated with said housing, an air pump having its suction side communicating with said tank, an elongated suction nozzle disposed under said housing floor behind and adjacent to said elongated brush means, and a manifold communicating said suction nozzle with said collection tank.

8. A machine as set forth in claim 7 said elongated transverse trough means being disposed in the upper portion of said supply tank; a plurality of vertical conduits defining said dispensing means for directing foam from said trough means to the floor surface at the front of said housing; and said adjustable gate means comprising an adjustable weir gate for controlling the flow of solution foam from the main supply tank chamber into said trough.

* * * * *